US008113134B2

(12) United States Patent
Ulgen

(10) Patent No.: US 8,113,134 B2
(45) Date of Patent: Feb. 14, 2012

(54) CHAIN STOWAGE MECHANISM FOR MARINE VEHICLES

(76) Inventor: Mehmet Nevres Ulgen, Istangul (TR)

( * ) Notice: Subject to any disclaimer, the term of this patent is extended or adjusted under 35 U.S.C. 154(b) by 172 days.

(21) Appl. No.: 12/425,880

(22) Filed: Apr. 17, 2009

(65) Prior Publication Data

US 2009/0272306 A1 Nov. 5, 2009

(51) Int. Cl.
*B63B 21/22* (2006.01)

(52) U.S. Cl. ..... 114/210

(58) Field of Classification Search ..... 114/210, 114/230.1, 230.2, 230.23, 199, 200, 293, 114/254, 268, 269; 254/371, 372, 361, 362, 254/382, 378

See application file for complete search history.

(56) References Cited

U.S. PATENT DOCUMENTS 2,599,200 A * 6/1952 Rogers ..... 114/179
5,314,166 A * 5/1994 Muir ..... 254/371
6,490,988 B2 * 12/2002 Caprioglio ..... 114/293

* cited by examiner

*Primary Examiner* — Daniel Venne
(74) *Attorney, Agent, or Firm* — Vidas, Arrett & Steinkraus, P.A.

(57) ABSTRACT

A mechanism for releasing and retracting an anchor chain into/from water in marine vehicles, comprising a stowing reservoir which is driven by a motor for automatically stowing the chain.

2 Claims, 5 Drawing Sheets

CHAIN STOWAGE MECHANISM FOR MARINE VEHICLES

FIELD OF INVENTION

The present invention relates to a mechanism designed for automatically and properly stowing the chain attached from an end to anchor of marine vehicles, such as boats, yachts, etc.

BACKGROUND OF INVENTION

The use of anchors attached from one end to a chain is known for restricting the oversea movement of marine vehicles to a desired point. The length of chain, and thus the number or size of links making up the chain are varying and the operation of stowing the chain, which occupies substantial place, requires a series control when the anchor is collected from the water. As a matter of fact, any random stowing of chain causes the links of chain to get tangled and prevents the performance of a proper anchoring operation.

Marine vehicles typically comprise a capstan for the chains, rotationally-driven by means of a motor, to release and retract the chain into/from water in a controlled manner. It is known, however, that during the stowing of chain, as it is retracted from water by means of the capstan, an operator frequently intervenes the stowed chain manually for preventing the tangling of chain links, this approach causes many disadvantageous though. Such drawbacks in current applications include for instance manpower loss, high injury risk for the operator, inefficient use of the stowing area due to the lack of properly stowing the chain, etc.

BRIEF DESCRIPTION OF INVENTION

The object of the present invention is to properly and automatically stow the chain used for releasing into and retracting back from water the anchors of marine vehicles, such as boats, yachts, etc.

In order to achieve this object, the present invention provides a mechanism, which allows to automatically stowing a chain collected from the water, this mechanism comprising a motor-drivable reservoir.

According to a preferred embodiment of the present invention, the internal geometric form of the chain stowing reservoir comprises a inclined form, starting from the upper cross-sectional periphery of the outer wall of the cylindrically-shaped reservoir downward and towards the center of the reservoir, and a conical structure, starting from the lower part (base) of the reservoir and extending upward.

DESCRIPTION OF FIGURES

The present invention is to be evaluated together with annexed figures briefly described hereunder to make clear the subject embodiment and the advantages thereof.

DESCRIPTION OF INVENTION

Figure 1:
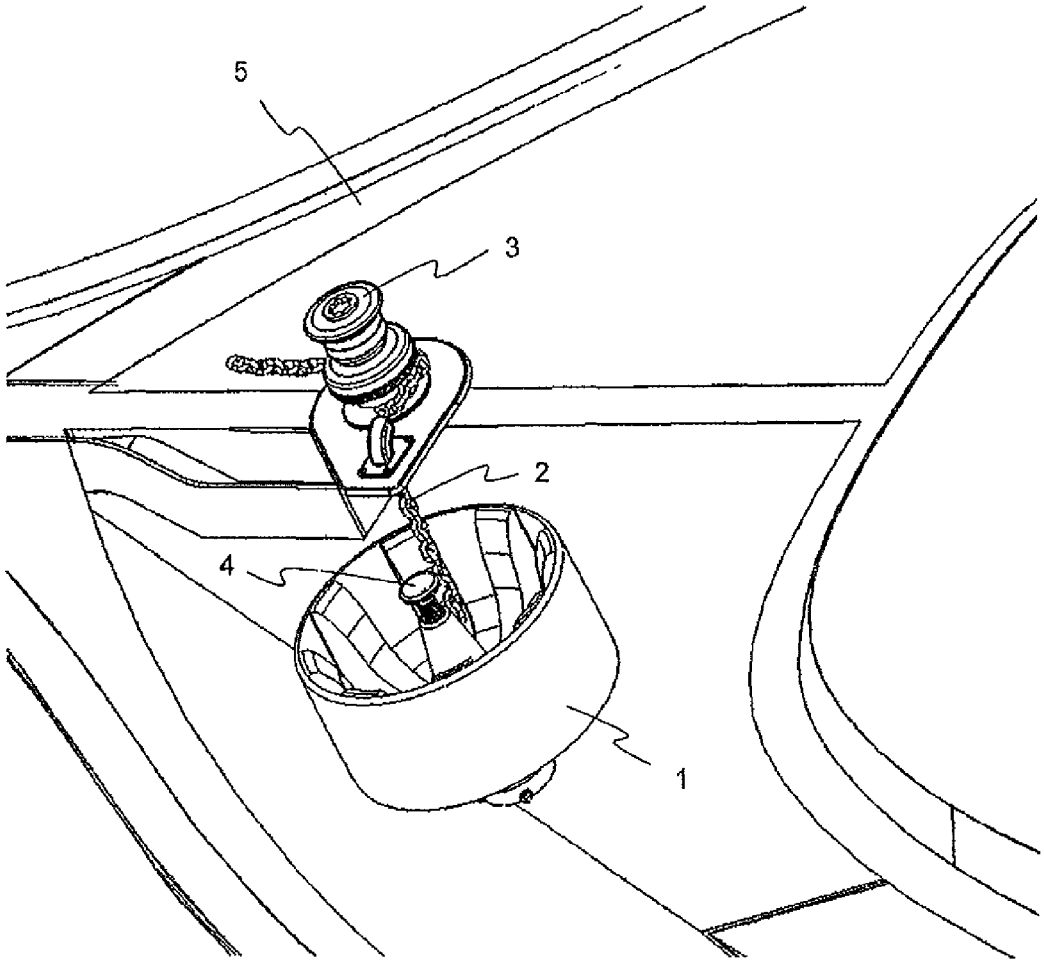
FIG. 1 is a view of the subject automatic chain stowing mechanism and the chain capstan on a boat.

As illustrated in FIG. 1, a chain capstan (3) according to the prior art is positioned on the hull surface of a marine vehicle (5), e.g. boat, yacht, etc., for releasing and retracting the chain (2) into/from water, one end thereof being connected to an anchor (not illustrated in figures for visual simplification). A motor (13) is disposed at the lower part of the chain capstan (3), such that once this motor (13) is driven, the chain (2) wrapped around the capstan (3) is released into or retracted from water in a controlled manner.

Figure 2:
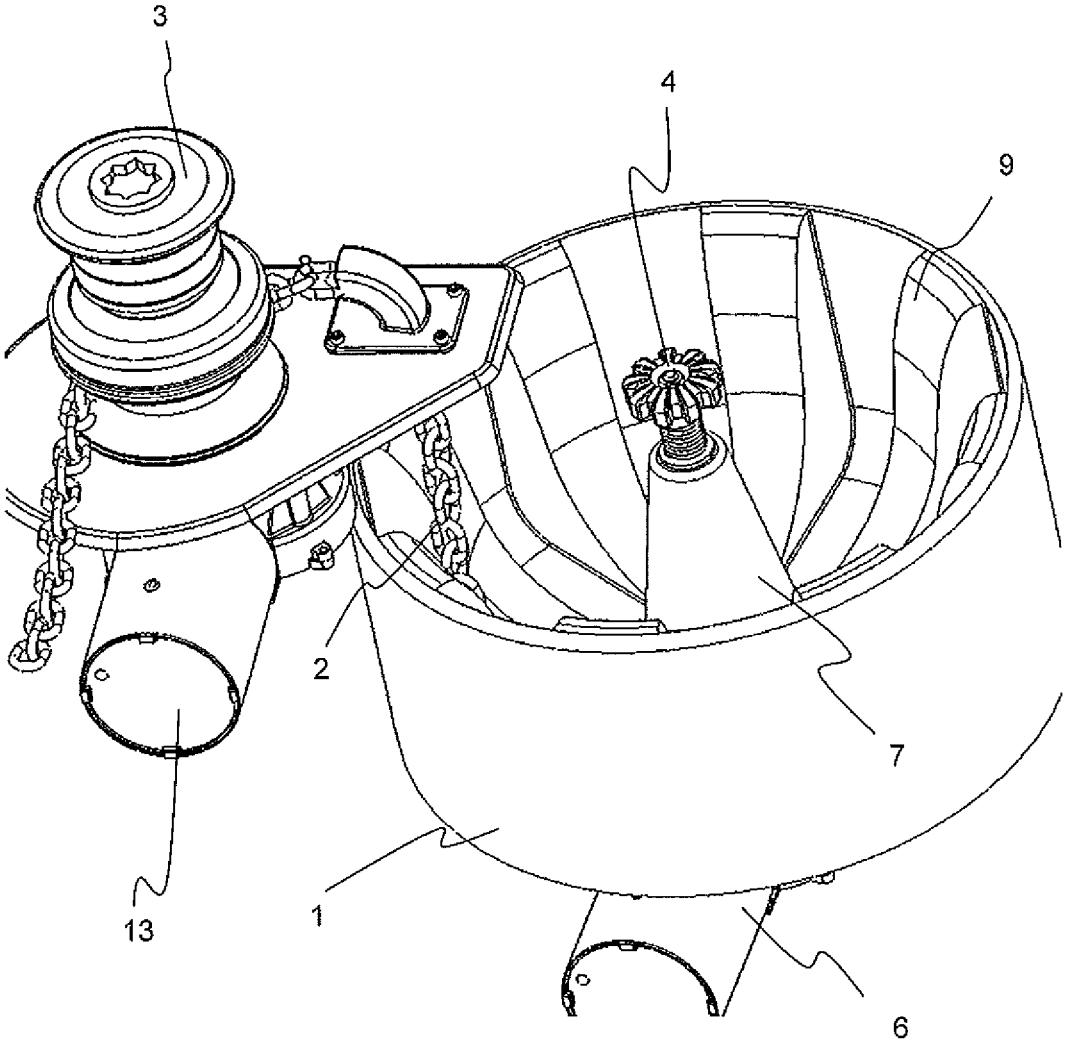
FIG. 2 is a perspective view of the subject automatic chain stowing mechanism, together with the chain capstan.
Figure 3:
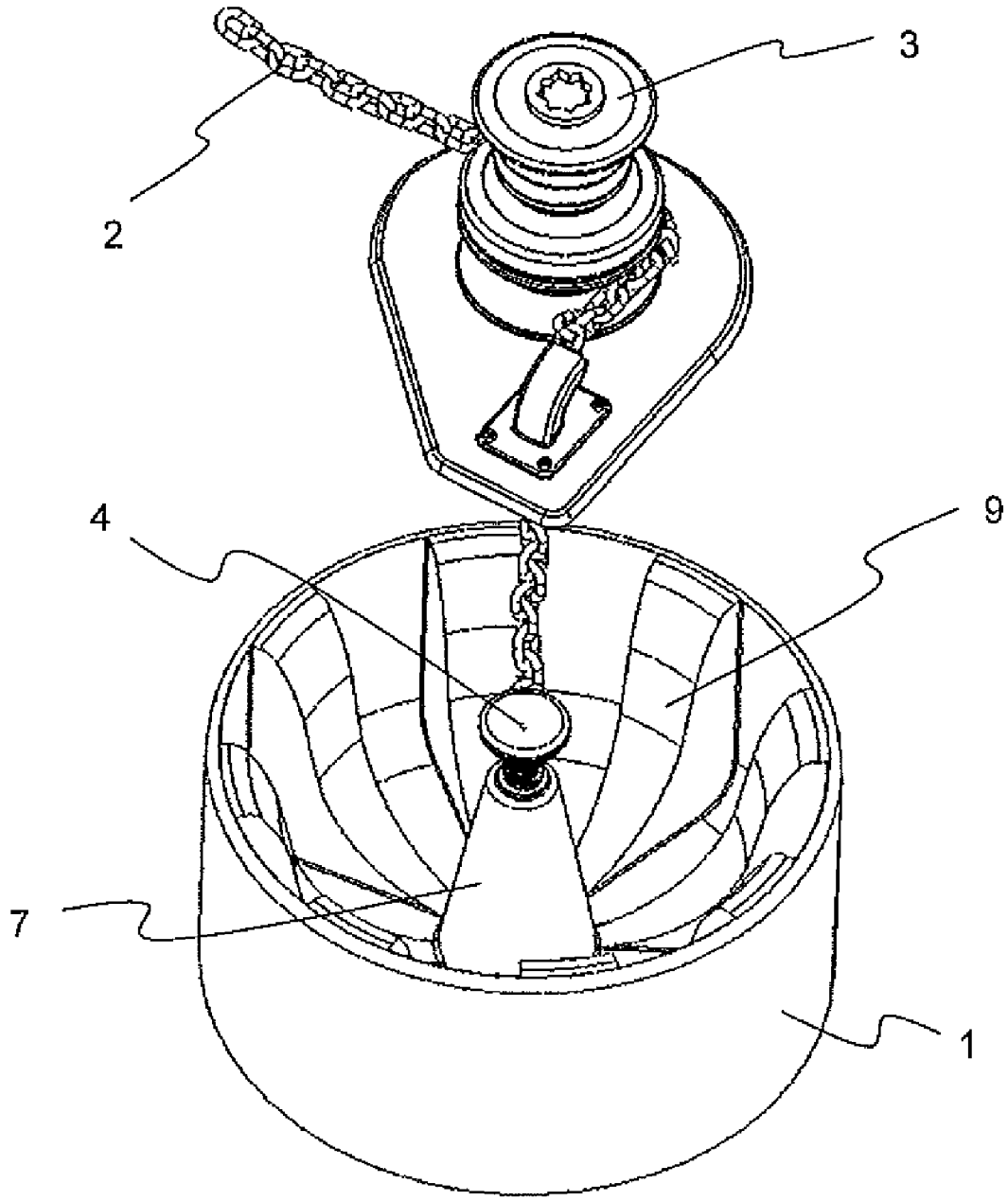
FIG. 3 is a view of the subject automatic chain stowing mechanism, together with the chain capstan, from another perspective.

According to a preferred embodiment of the present invention, as illustrated in FIGS. 2 and 3, a chain stowing reservoir (1) is disposed at the lower part of said chain capstan (3). The internal geometry of the chain stowing reservoir (1) comprises inclined members (9), starting from the upper cross-sectional periphery of the outer wall of the reservoir (1) downward and towards the center of the reservoir (1), and a conical part (7), starting from the base part of the reservoir (1) and extending upward in a tapering manner. By means of the geometrical shape of the central conical part (7) and inclined members (9), the chain (2) is stowed properly within the reservoir (1) without the links of said chain becoming tangled—the same proper operation being applicable when the chain is released into the water.

Figure 4:
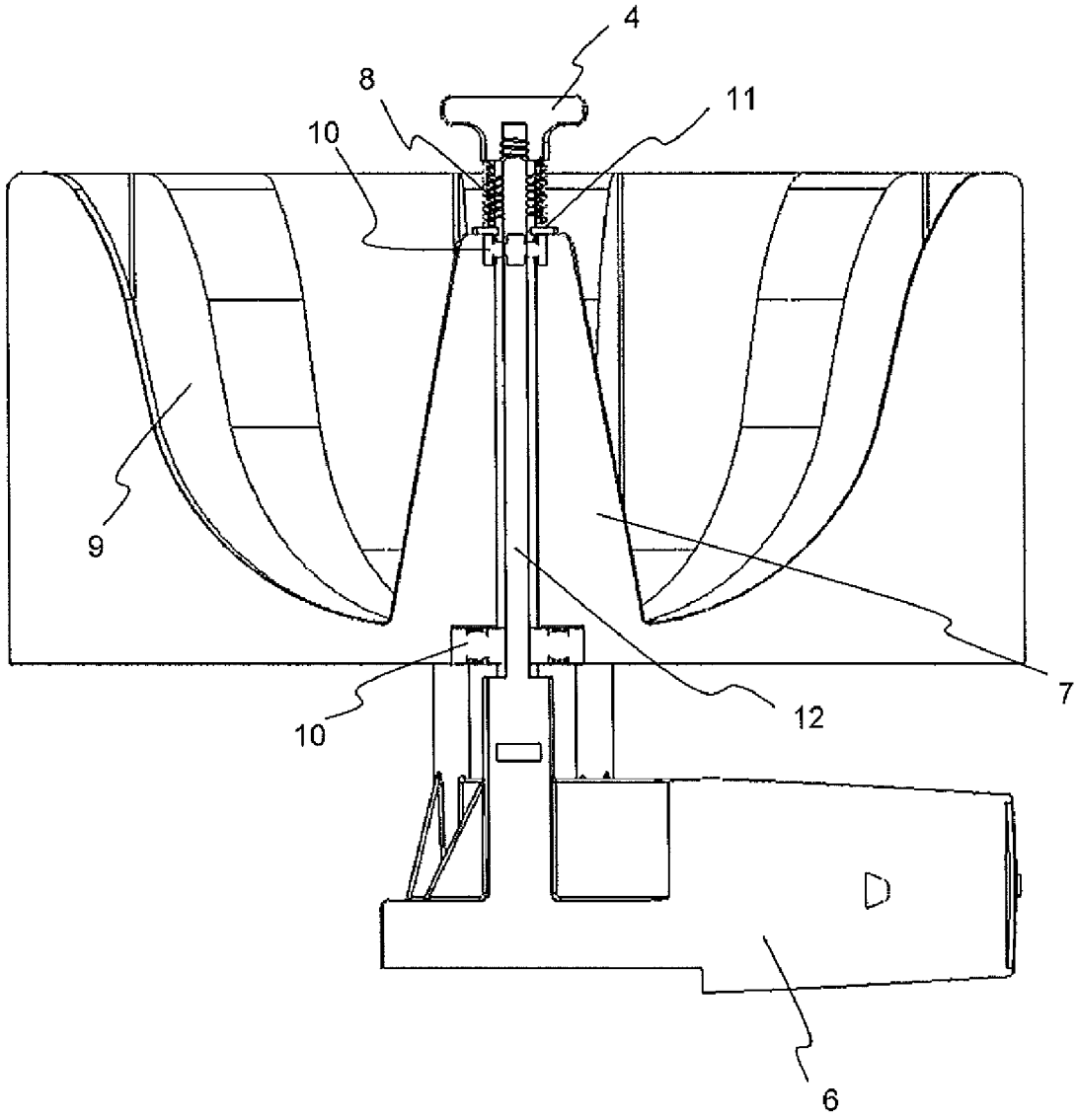
FIG. 4 is a perspective view of the subject automatic chain stowing mechanism, together with the chain capstan.

As illustrated in FIG. 4, a motor (6) is disposed at the lower side of the chain stowing reservoir (1), said motor (6) being connected directly or via a reducer to a shaft (12), disposed vertically in the center of the reservoir (1). The shaft (12) is connected to a central conical part (7) by means of a one-way rotating ball bearing (10). When the chain is pulled from the water, the shaft (12) is provided with torque by means of the drive of the motor (6), and since the ball bearings (10) are locked at this rotation direction of shaft (12)—due to the one-way rotation of ball bearings—the torque is transmitted to the reservoir (1) so that the latter is rotated.

As for the case when the chain (2) is released into the water, since the ball bearings (10) are forced to move at the permissible direction while the chain (2) in the stowing reservoir (1) is released therefrom, the reservoir (1) is rotated at the opposite direction, thus the chain (2) is unwound out of the stowing reservoir (1).

Figure 5:
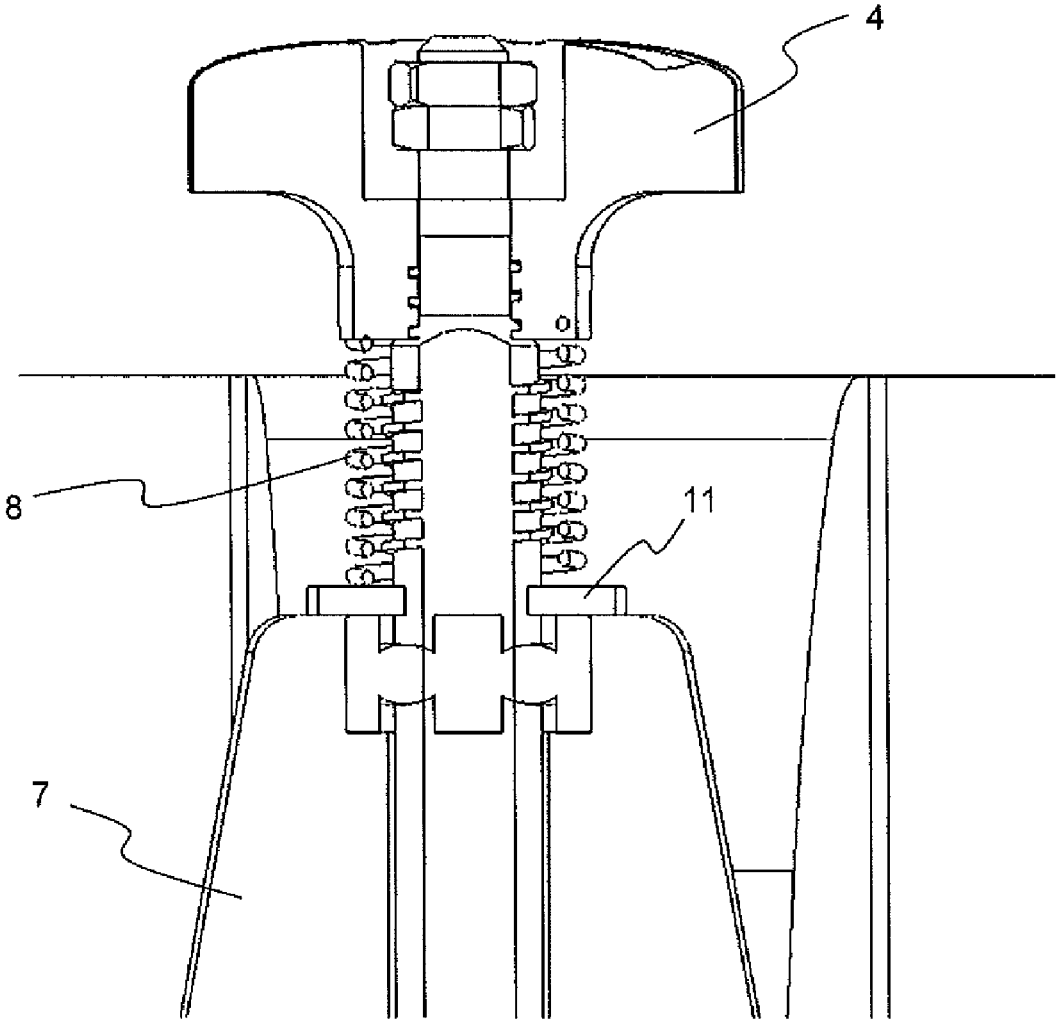
FIG. 5 illustrates a brake mechanism in the subject automatic chain stowing mechanism, which provides controlled releasing for the chain into water.

As illustrated in FIGS. 4 and 5, the upper side of the stowing reservoir (1) is provided with a braking mechanism composed of a brake holder (4), a spring (8) connected to the brake holder (4), and a brake disc (11) disposed underneath the spring (8) and contacted to the central conical part (7). By rotating the brake holder (4) to a desired extent, the compression extent of the spring and thus the compressive force exerted by the brake disc (11) onto the central conical part (7) is adjusted. By means of the brake mechanism, it is possible to control the unwinding speed of the chain (2) from the stowing reservoir (1).

The invention claimed is:

1. A mechanism for stowing anchor chain below a hull surface of a marine vehicle after said chain has been handled by a separate capstan, comprising:

a stowing reservoir (1) comprising an outer wall, a center and a base held below the hull surface in a marine vehicle;

the stowing reservoir further comprising inclined members starting from the outer wall of the reservoir and advancing downward to the center of the reservoir;

the stowing reservoir further including a central conical part, extending from the base of the center of the reservoir to upwards in a tapering manner; and a motor rotating the stowing reservoir, said motor rotating said stowing reservoir such that chain from said separate capstan enters said stowing reservoir and rotates around said reservoir between said inclined members and said central conical part to thereby lay said chain without being tangled.

2. A mechanism according to claim 1, further comprising:

a brake mechanism comprising a brake holder, a spring connected to the brake holder, and a brake disc provided underneath the spring and the brake disc exerting compressive force on the central conical part when the brake holder is rotated to a desired compression extent.

* * * * *